US007901061B2

(12) United States Patent
Takemoto

(10) Patent No.: US 7,901,061 B2
(45) Date of Patent: Mar. 8, 2011

(54) LIQUID DISCHARGE DEVICE

(75) Inventor: Takatoshi Takemoto, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 921 days.

(21) Appl. No.: 11/824,122

(22) Filed: Jun. 29, 2007

(65) Prior Publication Data

US 2008/0002002 A1 Jan. 3, 2008

(30) Foreign Application Priority Data

Jun. 30, 2006 (JP) ..... 2006-181778

(51) Int. Cl.
*B41J 2/175* (2006.01)

(52) U.S. Cl. ..... 347/85

(58) Field of Classification Search ..... 347/7, 84, 347/85

See application file for complete search history.

(56) References Cited

U.S. PATENT DOCUMENTS

| | | | | |
|---|---|---|---|---|
| 6,068,370 | A | 5/2000 | Miller et al. | |
| 6,234,615 | B1 * | 5/2001 | Tsukuda | 347/85 |
| 6,276,784 | B1 | 8/2001 | Ikkatai et al. | |
| 6,783,215 | B2 | 8/2004 | Yoshida et al. | |
| 6,799,840 | B2 | 10/2004 | Inamura | |
| 6,846,072 | B2 | 1/2005 | Sato et al. | |
| 6,866,372 | B2 * | 3/2005 | Oda et al. | 347/85 |
| 6,880,925 | B2 | 4/2005 | Yamaguchi et al. | |
| 7,290,849 | B2 | 11/2007 | Yamazaki et al. | |
| 7,407,241 | B2 | 8/2008 | Mutoh et al. | |
| 7,748,831 | B2 * | 7/2010 | Umeda | 347/85 |
| 2001/0038405 | A1 | 11/2001 | Ishizawa et al. | |
| 2002/0075364 | A1 | 6/2002 | Takahashi et al. | |
| 2003/0063167 | A1 | 4/2003 | Yoshida et al. | |
| 2003/0160848 | A1 | 8/2003 | Taniguchi et al. | |
| 2003/0202059 | A1 | 10/2003 | Kimura et al. | |
| 2004/0160496 | A1 | 8/2004 | Tsurui et al. | |

(Continued)

FOREIGN PATENT DOCUMENTS

| | | |
|---|---|---|
| JP | 4-358844 | 12/1992 |

(Continued)

OTHER PUBLICATIONS

Notice of Allowance of U.S. Appl. No. 11/824,117.

*Primary Examiner* — Anh T. N. Vo
(74) *Attorney, Agent, or Firm* — Frommer Lawrence & Haug LLP

(57) ABSTRACT

A liquid discharge device is provided with a casing, a carriage, a discharge head, a sub tank, a supply nozzle, and a moving device. The casing has a space for housing a main tank. The carriage is capable of moving. The discharge head is arranged on the carriage. The sub tank is also arranged on the carriage. The sub tank is communicated with the discharge head. The supply nozzle is to be communicated with the main tank. The moving device is capable of moving the supply nozzle with respect to the carriage in a way that the supply nozzle pierces through a first position of the sub tank and is inserted into the sub tank. Furthermore, the moving device is capable of moving the supply nozzle with respect to the carriage in a way that the supply nozzle pierces through a second position of the sub tank and is inserted into the sub tank. The second position is a different position from the first position.

12 Claims, 10 Drawing Sheets

U.S. PATENT DOCUMENTS

| | | | |
|---|---|---|---|
| 2004/0189753 | A1 | 9/2004 | Ikezaki |
| 2005/0024397 | A1 | 2/2005 | Mizoguchi |
| 2006/0274096 | A1 | 12/2006 | Kanda et al. |

FOREIGN PATENT DOCUMENTS

| | | |
|---|---|---|
| JP | 2001058415 | 3/2001 |
| JP | 2001162830 | 6/2001 |
| JP | 2001-219570 | 8/2001 |
| JP | 2002347258 | 12/2002 |
| JP | 2003175632 | 6/2003 |
| JP | 2004009447 | 1/2004 |
| JP | 2004-195929 | 7/2004 |
| JP | 2005007822 | 1/2005 |

* cited by examiner

LIQUID DISCHARGE DEVICE

CROSS-REFERENCE TO RELATED APPLICATION

This application claims priority to Japanese Patent Application No. 2006-181778, filed on Jun. 30, 2006, the contents of which are hereby incorporated by reference into the present application.

BACKGROUND OF THE INVENTION

1. Field of the Invention

The present invention relates to liquid discharge device that discharges liquid from a main tank to a sub tank that is arranged on a carriage.

2. Description of the Related Art

Ink jet printers having a so-called stationary supply mechanism are known. With the stationary supply mechanism, a sub tank that is capable of storing small amount of ink is arranged on a carriage. A print head used to print on the printing medium is also arranged on the carriage. Ink is supplied to the print head from the sub tank. A main tank that is capable of storing a large amount of ink is attached to a position separate from the carriage. The carriage is capable of moving. The movement of the carriage can be controlled easier with lighter load burdened onto the carriage. The sub tank and the main tank are separated in order to lighten the carriage load.

When the carriage moves to an ink supply position, the sub tank and the main tank are temporarily connected with a supply nozzle. The supply nozzle is inserted into the sub tank via a connecting position arranged on the sub tank, and the ink inside the main tank is replenished to the sub tank via the supply nozzle. The aforementioned configuration of the so-called stationary supply mechanism is disclosed in the Japanese Patent Application Publication No. 2001-162830.

In the aforementioned publication, a cover that can be rotated is arranged on the connecting position of the sub tank by using a spring. The supply nozzle is able to push the cover towards its opening direction, and be inserted into the sub tank. After the ink is replenished, as the supply nozzle is withdrawn from the sub tank, the cover is rotated towards its closing direction by the force of the spring.

Furthermore, a technique to connect the supply nozzle by arranging a rubber at the connecting position is taught in the U.S. Pat. No. 6,880,925. In the aforementioned publication, a joint rubber with a cleavage at its center is arranged on a print head. The ink tank, on the other hand, has a supply nozzle to supply ink to the print head. In the course of connecting the supply nozzle to the print head, the supply nozzle is inserted into the cleavage of the joint rubber. The elasticity of the joint rubber maintains the sealing of the print head, even in the course of inserting and withdrawing the supply nozzle.

BRIEF SUMMARY OF THE INVENTION

With the above-mentioned configurations, however, the construction of the connecting position may be degraded by the process of repeatedly inserting and withdrawing the supply nozzle. If the connecting portion of the sub tank is damaged, broken particles from the construction of the connecting position may be transferred into the sub tank in the course of connecting the supply nozzle to the sub tank. Such foreign substances give rise to undesirable conditions such as clogging of filter inside the sub tank, which often consequently blocks discharge from the print head.

Furthermore, the construction of the connecting position of the sub tank may be fatigued due to the repetition of the process of inserting and withdrawing the supply nozzle. For example, the spring that is supporting the cover towards the closing direction may be broken or fatigued, or the rubber may be torn and the cleavage thereof may be enlarged, due to the repetitive insertion of the supply nozzle. If such conditions occur, the sealing of the connecting position may be loosened. If the sealing of the connecting position is demeaned, the ink inside the sub tank may be exposed to air, and the viscosity of ink is increased from drying. Such undesirable condition also gives rise to clogging of filter inside the sub tank and blocking of discharge from the print head, and the like.

The present specification discloses a technique that is capable of inhibiting undesirable phenomenon from occurring by repeatedly inserting the supply nozzle into the sub tank.

A liquid discharge device disclosed in the present specification includes a casing, a carriage, a discharge head, a sub tank, a supply nozzle, and a moving device. The casing has a space for housing a main tank. The carriage is capable of moving. The discharge head is arranged on the carriage. The sub tank is also arranged on the carriage. The sub tank communicates with the discharge head. The supply nozzle is to be communicated with the main tank. The moving device is capable of moving the supply nozzle with respect to the carriage such that the supply nozzle pierces through a first position of the sub tank and is inserted into the sub tank. Furthermore, the moving device is capable of moving the supply nozzle with respect to the carriage such that the supply nozzle pierces through a second position of the sub tank and is inserted into the sub tank, and the second position is a different position from the first position.

With the aforementioned configuration, the moving device is capable of changing a piercing position of the supply nozzle with respect to the sub tank. Such configuration may inhibit undesirable phenomenon from occurring at the piercing position of the sub tank.

DETAILED DESCRIPTION OF THE INVENTION

Figure 1:
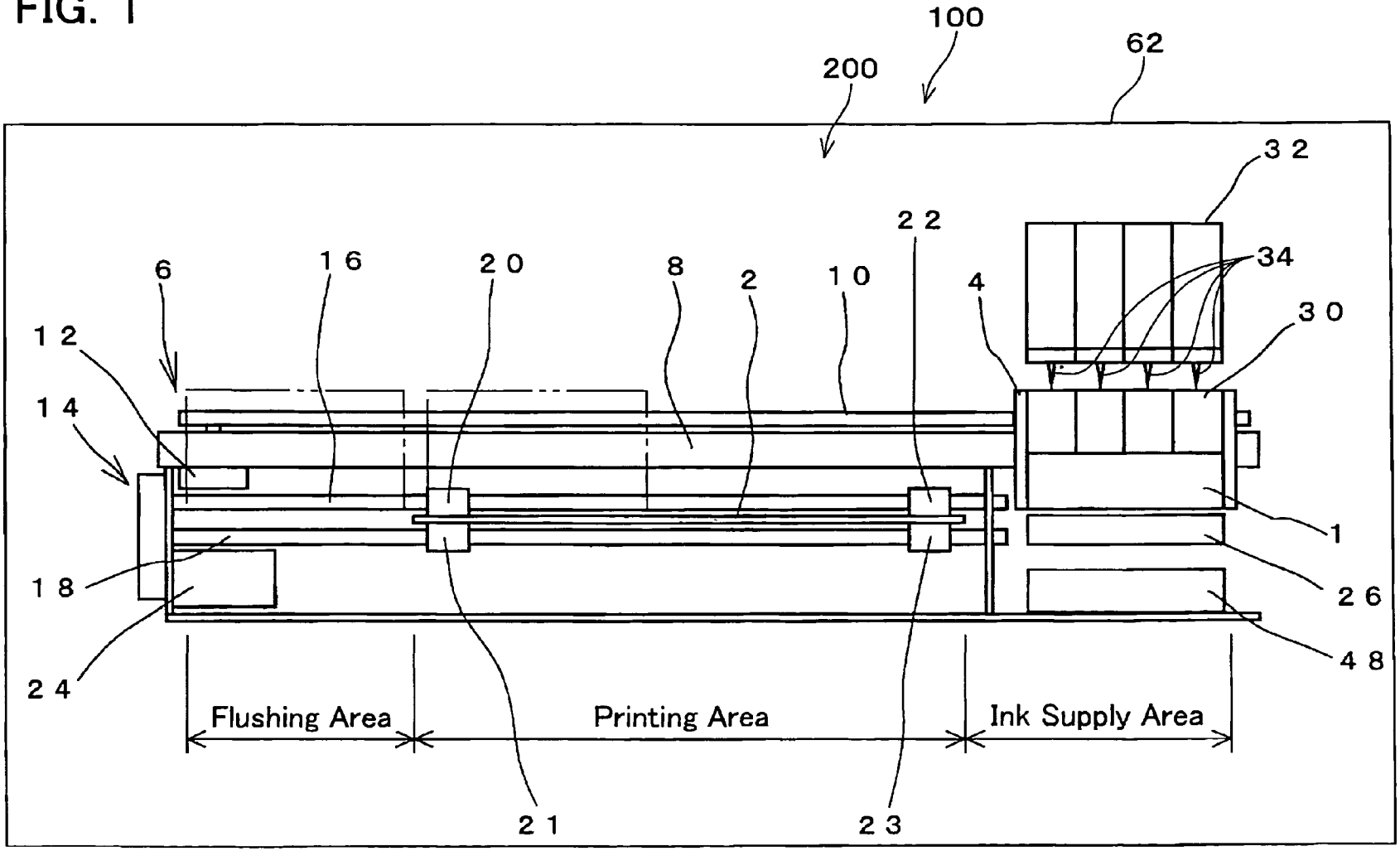
FIG. 1 shows a schematic plan view of an ink jet printer utilizing an ink supply device.

FIG. 1 shows a schematic plan view of an ink jet printer 100 utilizing an ink supply device 200. The ink jet printer 100 has a casing 62 that houses the ink supply device 200, which comprises the components as described below.

Within the casing 62, the ink supply device 200 has a print head 1, which is of an ink jet type. The print head 1 utilizes piezoelectric elements or thermoelectric elements to discharge ink drops onto the printing medium 2 that is fed underneath the print head 1. An image is printed on the printing medium 2, such as a paper, in accordance with data input to the ink jet printer 100.

The print head 1 is mounted onto a carriage 4. The carriage 4 is moved using a carriage driving mechanism 6. The carriage driving mechanism 6 includes a timing belt 10 that is arranged along a guide member 8. The timing belt 10 is connected to the carriage 4, and is driven by a motor 12 arranged on the guide member 8. The driving force of the motor 12 is exerted on the timing belt 10, and rotates the timing belt 10. The carriage 4 can thus be moved back and forth along the guide member 8. Moreover, a sub tank 30 is also mounted on the carriage 4 with the print head 1. The sub tank 30 stores ink inside, and provides the ink to the print head 1.

The printing medium 2 is fed by a paper feeding mechanism 14 in a perpendicular direction to the moving direction of the carriage 4. The paper feeding mechanism 14 includes roller shafts 16, 18 that are arranged parallel to the guide member 8. Two pairs of supply rollers 20, 21 and 22, 23 are arranged on the roller shafts 16, 18 in such a manner that the printing medium 2 can be caught and fed between the supply rollers 20 and 21, and also between the supply rollers 22 and 23. In the course of sending the printing medium 2 through the paper feeding mechanism 14, the roller shafts 16, 18 are rotated by a feeding motor 24.

The carriage 4 is moved by the carriage driving mechanism 6 in its moving direction, through a flushing area, a printing area, and an ink supply area. The flushing area and the ink supply area are arranged on either side of the printing area which is an area the printing medium 2 occupies during the printing process. When the carriage 4 is in the flushing area or the ink supply area, the print head I is also outside the printing area. Even when ink is discharged within the flushing area or the ink supply area, the printing medium 2 is not within the marking range of the ink. When the carriage 4 is moved into the flushing area, a compulsory flushing of ink from the print head 1 is processed.

When data to process printing is input to the ink jet printer 100 and printing process is performed, the carriage 4 moves within the printing area. The carriage 4 is at its printing position during printing, and the print head 1 discharges ink onto the printing medium 2 in accordance with the printing data. The carriage 4 moves to the ink supply area when replenishing ink to the sub tank 30 and also when the ink jet printer 100 is not performing printing process.

In the ink supply area, a cap 26 is arranged. The cap 26 covers discharge nozzles (not shown in the figures) of the print head 1, to prevent the ink inside the print head 1 from drying when the carriage 4 is in the ink supply area. The cap 26 can be moved by a moving mechanism, not shown in the figures, between a sealing position and a stand-by position. The cap 26 covers the discharge nozzles in the sealing position, and when the cap 26 is retracted lower with respect to the print head 1 to the stand-by position, it is separated from the print head 1.

In the ink supply area, a main tank 32 is detachably housed in the casing 62. The main tank 32 is houses separately from the sub tank 30. The main tank 32 is communicated with a supply nozzle 34 when it is set at a predetermined position within the casing 62. When the carriage 4 moves into the ink supply area and stops at a predetermined ink supply position, sub tank 30 and the main tank 32 are temporarily connected, and the ink inside the main tank 32 is replenished to the sub tank 30 via the supply nozzle 34.

In the ink supply area, a foam 48 is also arranged under the supply nozzle 34. The foam 48 is arranged at a position where the ink discharged from the supply nozzle 34 drips. In the case when the cap 26 is in its stand-by position and the carriage 4 is not within the ink supply area, the ink discharged from supply nozzle 34 falls onto the foam 48 placed below.

Figure 2A:
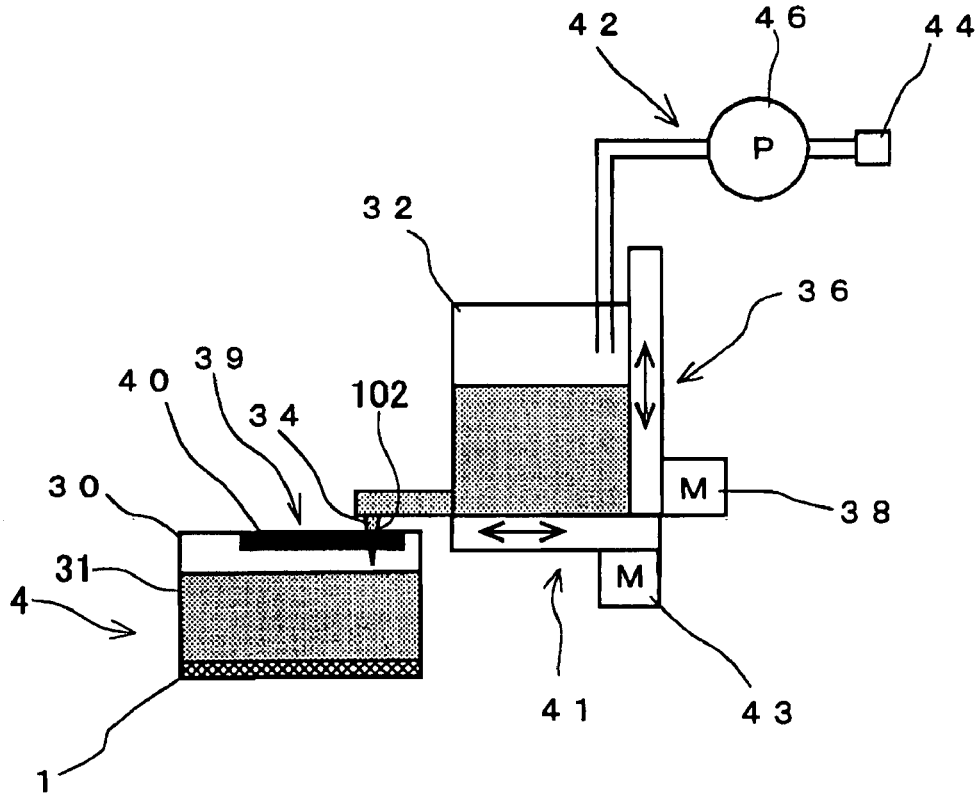
FIG. 2A shows a schematic view of a sub tank and a supply nozzle connected at a first position.
Figure 2B:
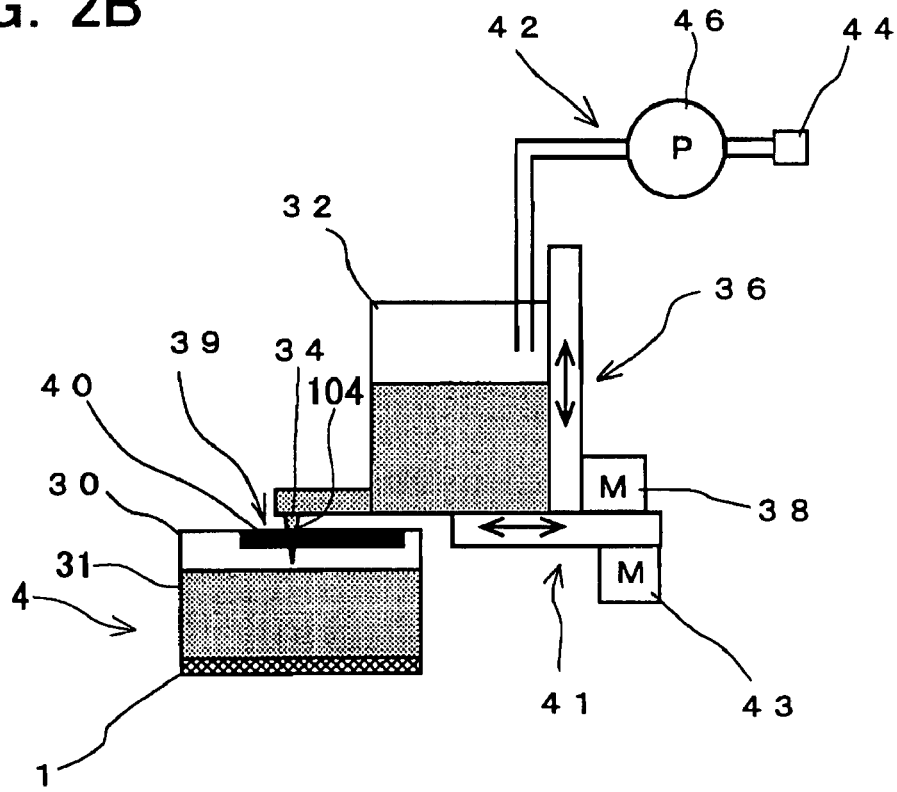
FIG. 2B shows a schematic view of the sub tank and the supply nozzle connected at a second position.
Figure 3A:
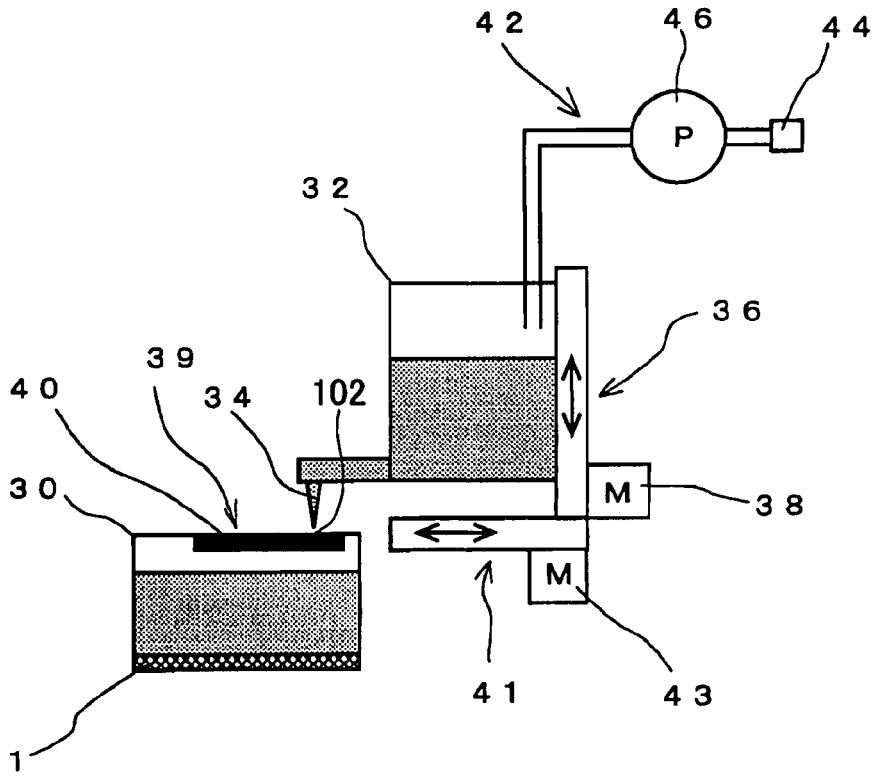
FIG. 3A shows a schematic view of the sub tank and the supply nozzle disconnected at the first position.
Figure 3B:
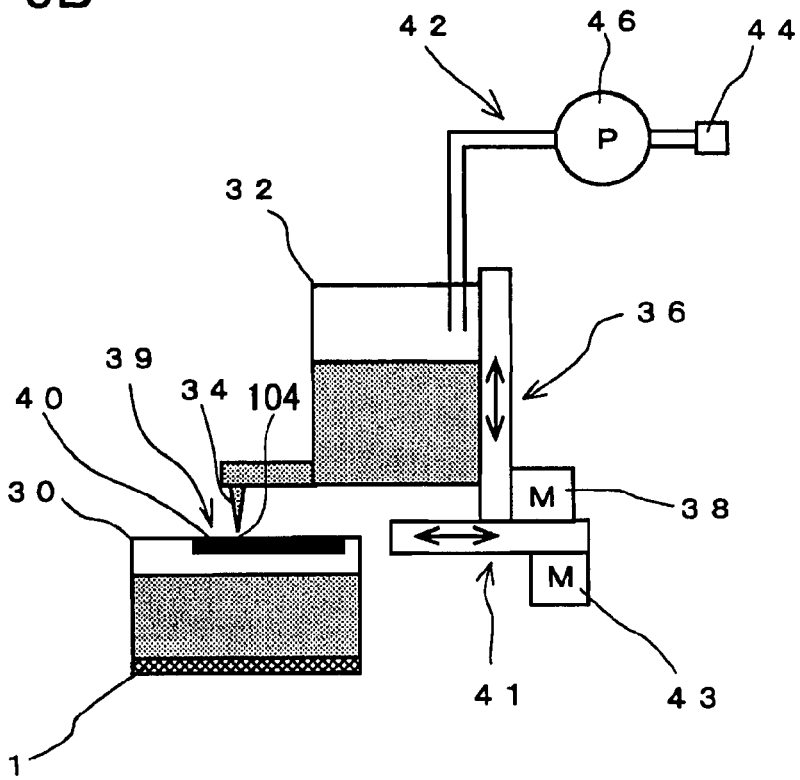
FIG. 3B shows a schematic view of the sub tank and the supply nozzle disconnected at the second position.
Figure 4A:
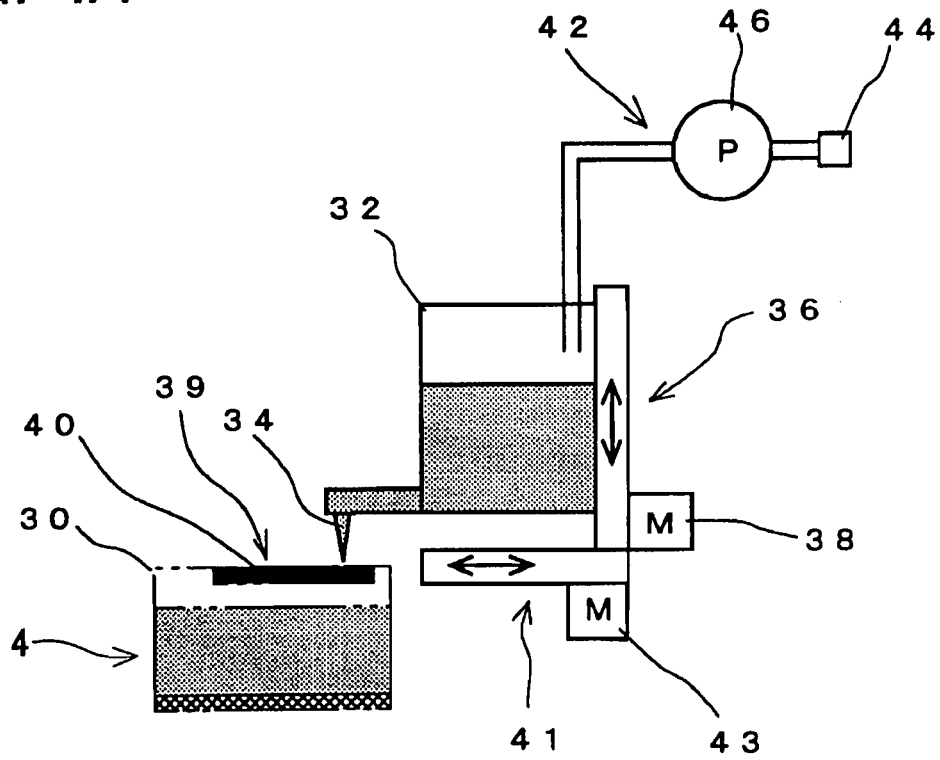
FIG. 4A shows a schematic view of the supply nozzle and the carriage in the printing area.
Figure 4B:
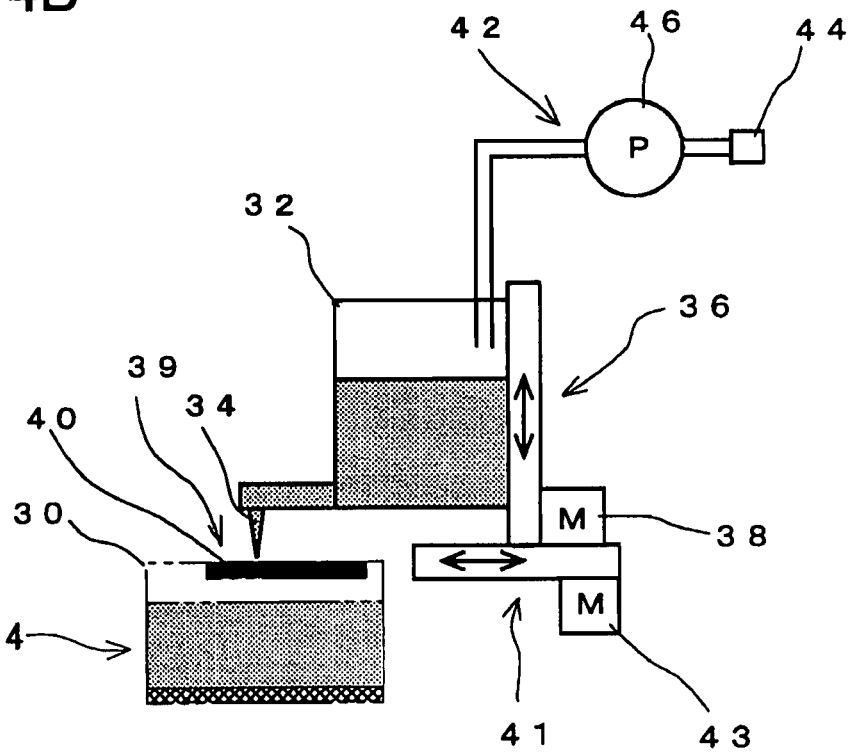
FIG. 4B shows a schematic view of the supply nozzle and the carriage in the printing area.
Figure 5:
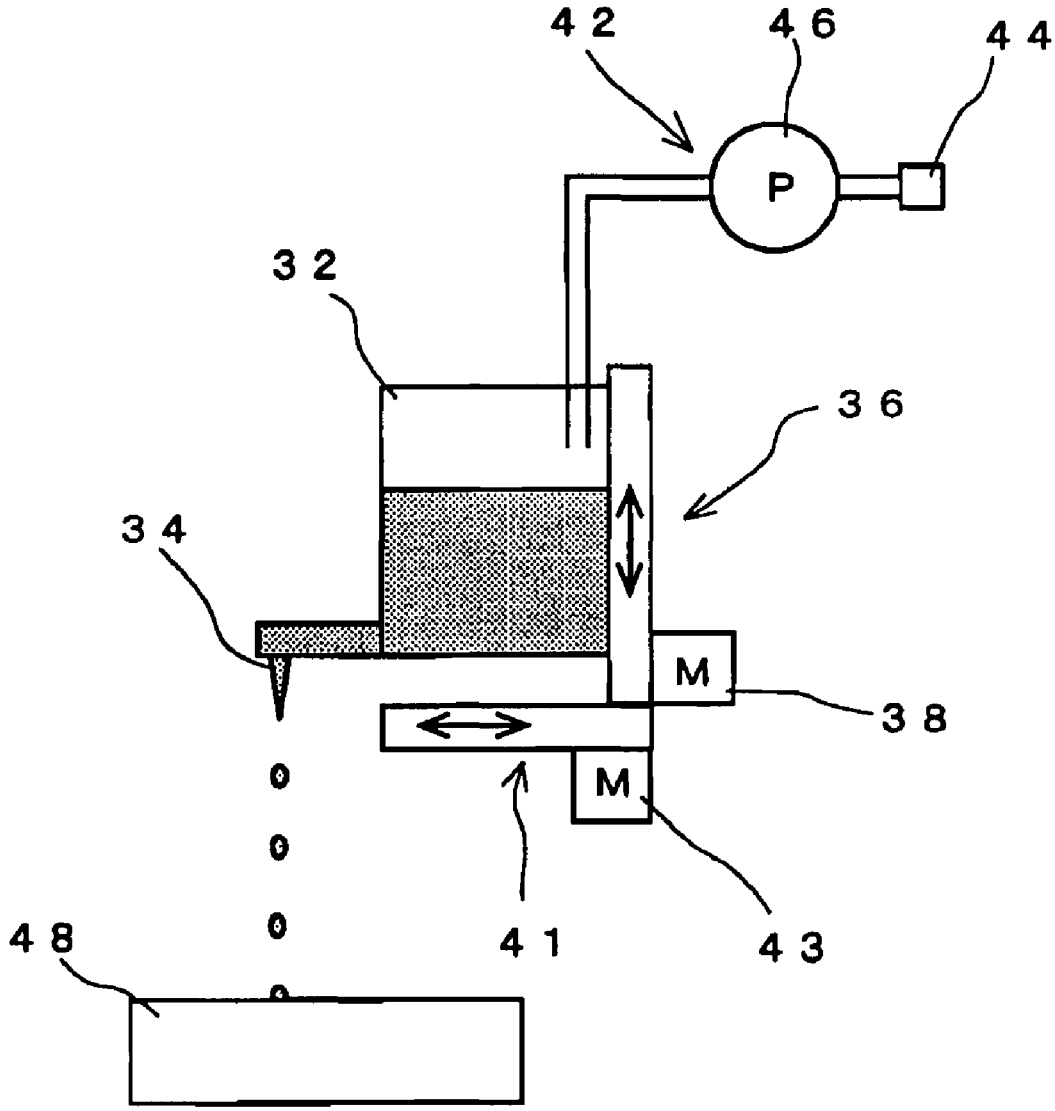
FIG. 5 shows a schematic view of the ink supply device performing a preliminary discharge.
Figure 6A:
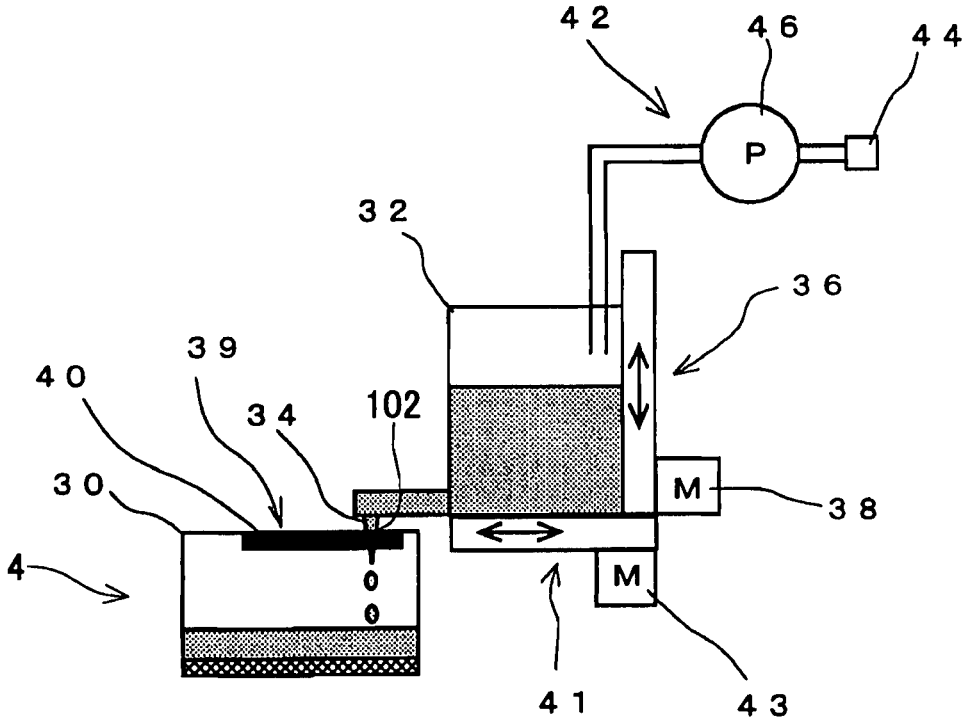
FIG. 6A shows a schematic view of the ink supply device replenishing ink to the sub tank at the first position.
Figure 6B:
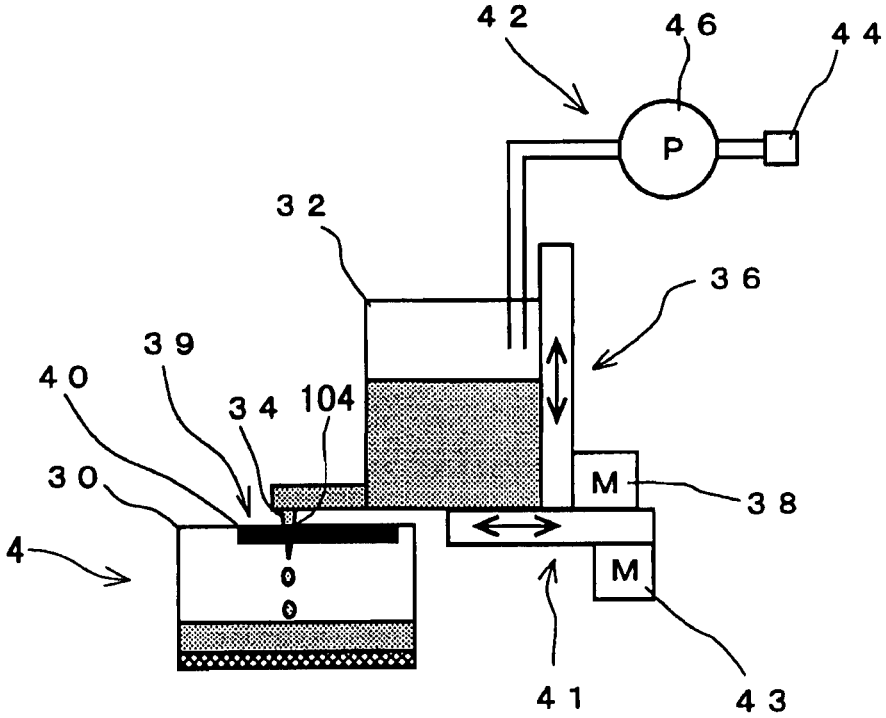
FIG. 6B shows a schematic view of the ink supply device replenishing ink to the sub tank at the second position.

FIG. 2A shows a schematic view of the sub tank 30 and the supply nozzle 34 connected at a first position 102, and FIG. 2B shows a schematic view of the sub tank 30 and the supply nozzle 34 connected at a second position 104. FIG. 3A shows a schematic view of the sub tank 30 and the supply nozzle 34 disconnected at the first position 102, and FIG. 3B shows a schematic view of the sub tank 30 and the supply nozzle 34 disconnected at the second position 104. FIG. 4A shows a schematic view of the supply nozzle 34 and the carriage 4 in the printing area, and FIG. 4B shows a schematic view of the supply nozzle 34 and the carriage 4 in the printing area. FIG. 5 shows a schematic view of the ink supply device 200 performing a preliminary discharge. FIG. 6A shows a schematic view of the ink supply device 200 replenishing ink to the sub tank 30 at the first position 102, and FIG. 6B shows a schematic view of the ink supply device 200 replenishing ink to the sub tank 30 at the second position 104. The print head 1 and sub tank 30 in FIGS. 4A and 4B are shown with dotted lines, to accentuate that the carriage 4 is in the printing area in FIGS. 4A and 4B.

As shown in FIGS. 2A and 2B, in the present embodiment, a connecting mechanism 36 and a connecting position adjusting mechanism 41 are arranged to move the supply nozzle 34 and the main tank 32 so that the supply nozzle 34 pierces through one of the connecting position among the first position 102 and the second position 104, and is inserted into the sub tank 30. The connecting positions, the first position 102 and the second position 104, are located at different positions. The connecting mechanism 36 and the connecting position adjusting mechanism 41 are capable of changing the connecting position of the supply nozzle 34 and the sub tank 30, from the first position 102 to the second position 104, or from the second position 104 to the first position 102.

The connecting mechanism 36 is driven by a motor 38, and moves the supply nozzle 34 and the main tank 32 in the up and down direction, that is, the direction orthogonal to the printing surface of the printing medium 2. As shown in FIGS. 2A, 2B and FIGS. 6A, 6B, with the aforementioned connecting mechanism 36, the supply nozzle 34 is moved downward. With the carriage 4 at the ink supply position, the supply nozzle pierces through a connecting member 39 at one of the aforementioned connecting positions.

The connecting position adjusting mechanism 41, on the other hand, is driven by a motor 43 and moves the supply nozzle 34 and the main tank 32 parallel to the surface of the connecting member 39; that is, in the left and right direction shown with arrow in FIGS. 3A and 3B. The position of which the supply nozzle 34 pierces through the seal member 40 is adjusted by the connecting position adjusting mechanism 41. For example, when the connecting position adjusting mechanism 41 moves the main tank 32 and the supply nozzle 34 from the position shown in FIG. 3A to the position shown in FIG. 3B, the connecting position where the supply nozzle 34 pierces the connecting member 39 is adjusted from the first position 102 as shown in FIG. 2A to the second position 104 as shown in FIG. 2B.

The connecting member 39 is arranged on a main body 31 of the sub tank 30. The connecting member 39 has a connecting hole (not shown in the figures) and a seal member 40. The connecting hole is formed on the main body 31 of the sub tank 30. The seal member 40 is made of elastomeric material. It may also be made of other elastic materials. The seal member 40 is arranged to cover the connecting hole. The seal member 40 is detachably coupled to the main body 31 of the sub tank 30, for example, using a double-sided adhesive tape. The first position 102 and the second position 104, through which the supply nozzle 34 pierces, are located on the seal member 40.

When the carriage 4 is at the ink supply position within the ink supply area, the supply nozzle 34 can be lowered so as to pierce through one of the aforementioned connecting positions on the seal member 40 and into the connecting hole by the connecting mechanism 36 and the connecting position adjusting mechanism 41. As a result of the lowering movement, the supply nozzle 34 is pierced through one of the connecting positions, thus the supply nozzle 34 and the sub tank 30 are connected. In FIG. 2A, for example, the supply nozzle 34 is inserted into the sub tank 30 by piercing through the seal member 40 at the first position 102.

Furthermore, in the case shown in FIG. 2A, by moving the supply nozzle 34 in the upward direction using the connecting mechanism 36, the supply nozzle 34 is pulled out from the seal member 40. As shown in FIG. 3A, the supply nozzle 34 and the sub tank 30 are disconnected at the first position 102, while, simultaneously, a hole formed at the first position 102 by the supply nozzle 34 is clogged by the restoration force of the elastomeric material. As a result, the sub tank 30 is sealed, and the transfer of dust therethrough and the drying of ink are prevented.

The connecting hole (not shown) and the seal member 40 are formed large enough for the supply nozzle 34 to be inserted at at least two different positions, that is, the first position 102 and the second position 104 in this embodiment. The connecting hole can consist of one large hole, or a hole elongated in the left-right direction in FIG. 3, and the seal member 40 can be formed large enough to cover such hole. Furthermore, a plurality of connecting holes and a plurality of seal members 40 can be arranged on the sub tank 30, where each seal member 40 covers the corresponding connecting hole. In such case, the first position 102 and the second position 104 may or may not be located within the same sealing member 40, provided that the first position 102 and the second position 104 are located at different positions. Furthermore, the supply nozzle 34 may also pierce through the seal member 40 at positions other than the aforementioned positions.

In the present embodiment, the connecting mechanism 36 moves the main tank 32 and the supply nozzle 34 in the up and down direction to connect or disconnect the supply nozzle 34 and the sub tank 30. However, the connecting mechanism 36 is not restricted to such construction. For example, the main tank 32 and the supply nozzle 34 can be connected by an elastic tube or the like, and the connecting mechanism 36 may only move the supply nozzle 34. Moreover, the connecting mechanism 36 may move the supply nozzles 34 in a rotating direction rather than in a straight direction. In this case, the supply nozzle 34 can be swung around a shaft pin arranged at its rotating center to connect and disconnect with the sub tank 30. Furthermore, the supply nozzle 34 can be moved in a horizontal direction or the left-right direction, or in an angled direction. In all of the aforementioned cases, the connecting mechanism 36 is able to connect and disconnect the supply nozzle 34 and the sub tank 30.

In the present embodiment, the connecting position adjusting mechanism 41 moves the main tank 32 and the supply nozzle 34 in a direction parallel to the surface of the connecting member 39 to determine the connecting position. However, the configuration of the connecting position adjusting mechanism 41 is not restricted to the above. The direction in which the connecting position adjusting mechanism 41 moves the main tank 32 and the supply nozzle 34 is determined in accordance with the form of the seal member 40. If the seal member 40 is elongated in the moving direction of the carriage 4, the connecting position adjusting mechanism 41 may move the main tank 32 and the supply nozzle 34 in the corresponding direction to adjust the position which the supply nozzle 34 pierces, so that the sub tank 30 and the supply nozzle 34 can be connected at different positions. Furthermore, the connecting position adjusting mechanism 41 may move the supply nozzle 34 solely without moving the main tank 32.

Furthermore, a pump mechanism 42 is arranged to supply energy to the ink inside the main tank 32. The pump mechanism 42 includes a filter 44, and a pump 46. The pump mechanism 42 draws in air through the filter 44, which is compressed and driven into the main tank 32 by the pump 46. When the compressed air is pumped into the main tank 32, according amount of ink stored inside the main tank 32 are discharged from the supply nozzle 34. The pump mechanism 42 is not restricted to the aforementioned construction. For example, a pump may be arranged at the ink passage between the main tank 32 and the supply nozzle 34, and compress the ink thereof. Furthermore, the device that supplies energy to the ink inside the main tank 32 may include constructions other than the pump mechanism 42.

The sub tank 30 and the main tank 32 may each distinctively store ink of plurality of colors: cyan, yellow, magenta, and black. The tanks of the aforementioned colors of ink may be formed as one component, or the colored ink may be stored in separate tanks. In the present embodiment, one set of the supply nozzle 34 and the pump mechanism 42 is arranged for each of the colored ink. The connecting mechanism 36 and the connecting position adjusting mechanism 41 may move the sets for the aforementioned four types of colored ink simultaneously in the same direction. Furthermore, the aforementioned sets may also be moved separately.

Figure 7:
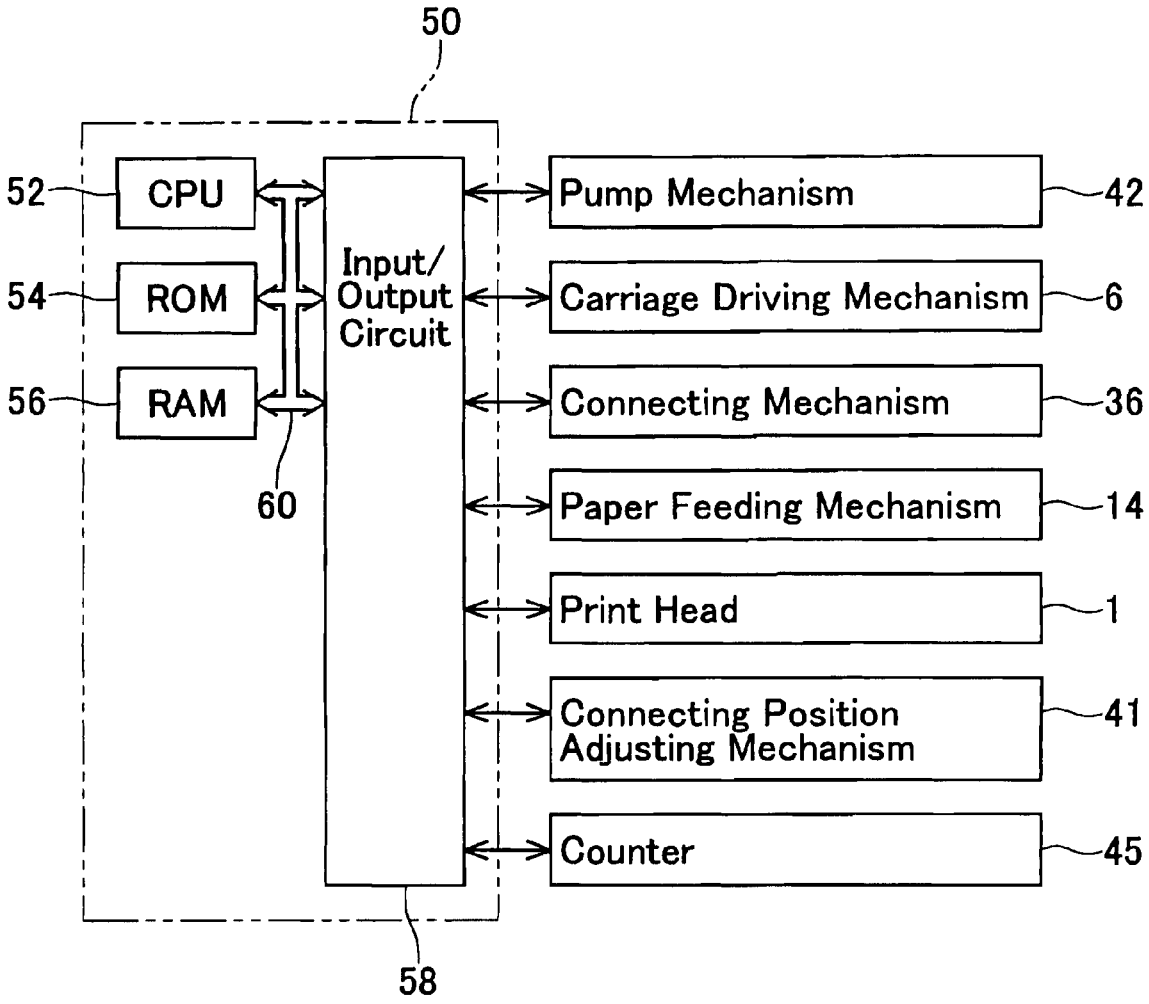
FIG. 7 shows a schematic view of the electrical system of the ink jet printer.

FIG. 7 shows a schematic view of the electrical system of the ink jet printer 100. As shown in FIG. 7, the aforementioned print head 1, carriage driving mechanism 6, paper feeding mechanism 14, connecting mechanism 36, connecting position adjusting mechanism 41, pump mechanism 42, and a counter 45 are connected to a controller 50. The controller 50 includes a CPU 52, a ROM 54 and a RAM 56 as the main components of the logic operation circuit. The aforementioned components of the logic operation circuit are connected to an input/output circuit 58 via a common bus 60. The input/output circuit 58 inputs signal from and outputs signal to the exterior mechanisms connected thereof. The CPU 52 controls the print head 1, carriage driving mechanism 6 and paper feeding mechanism 14 via the input/output circuit 58 so that the carriage 4 is moved back and forth in the moving direction while the print head 1 discharges ink onto the printing medium 2 that is fed into the printing area. Furthermore, the CPU 52 controls the carriage driving mechanism 6, the connecting mechanism 36, the connecting position adjusting mechanism 41, the pump mechanism 42, and the counter 45 in order to replenish ink to the sub tank 30. These controls are operated according to the data and control program stored in the ROM 54 and RAM 56.

Figure 8A:
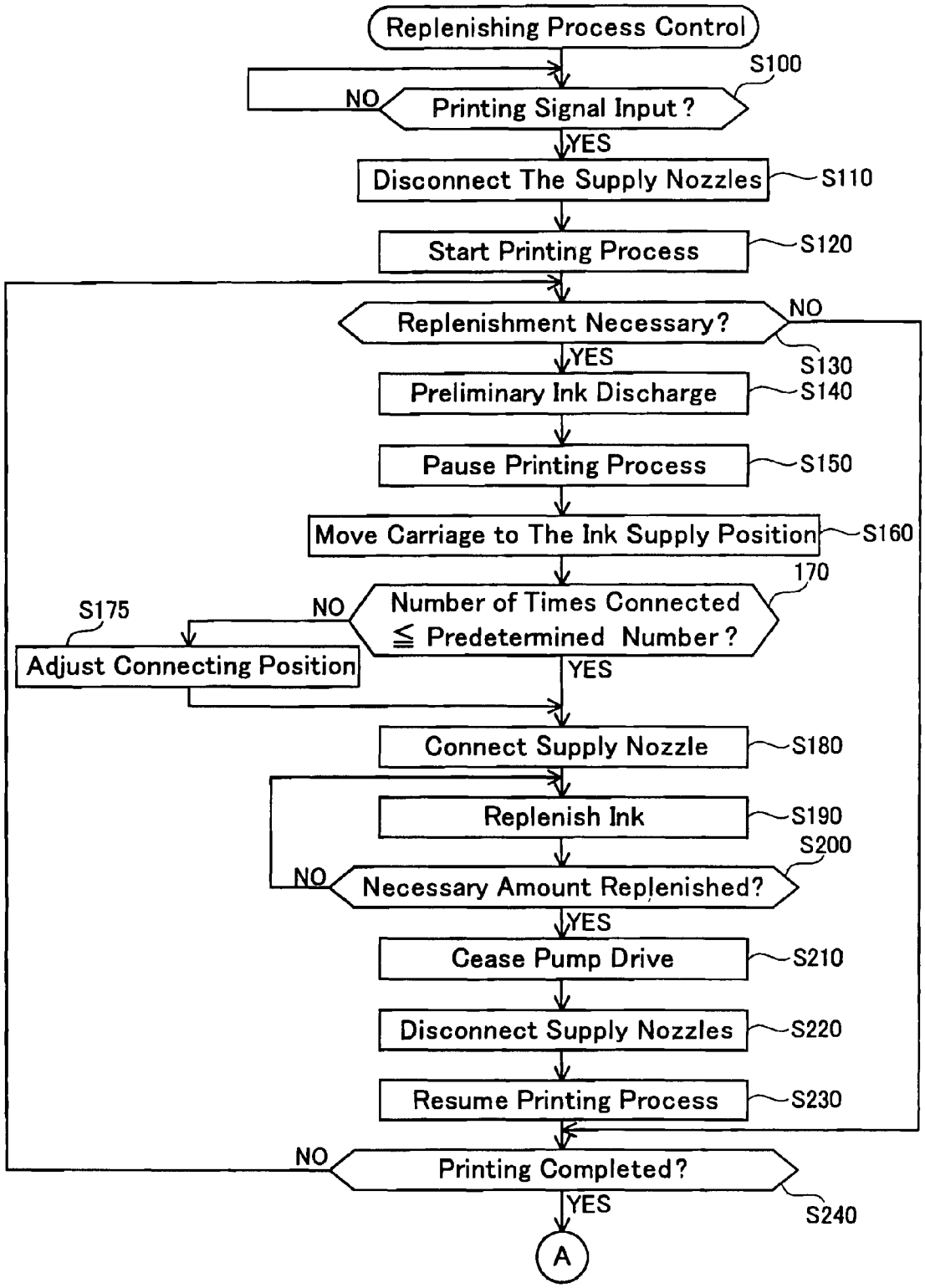
FIG. 8A and FIG. 8B show a flow chart of a replenishing process.
Figure 8B:
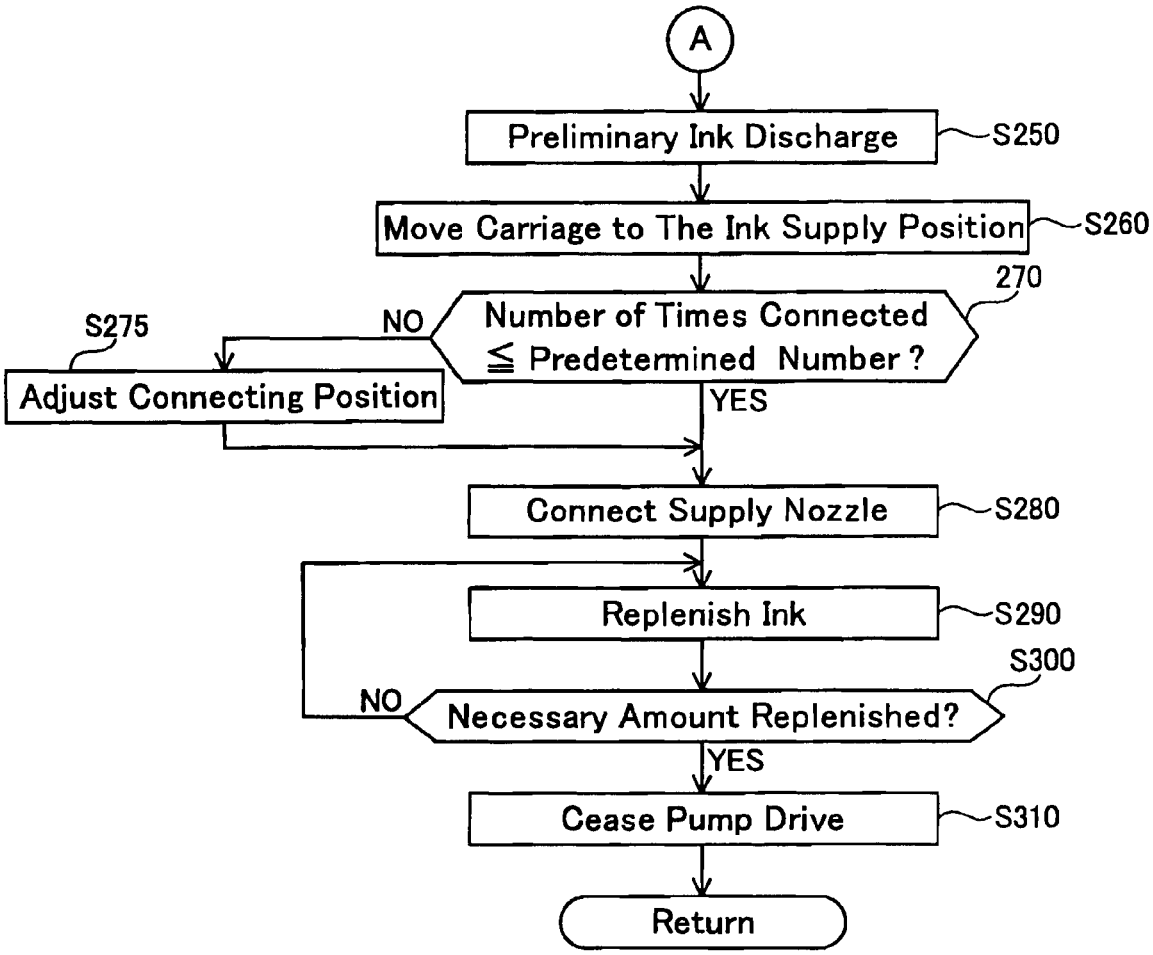

FIGS. 8A and 8B show flow chart of the replenishing process. As shown in FIG. 8A, when the replenishing process is carried out, whether or not a printing signal has been input is determined (S100). If the printing signal is not input ("NO" in S100), the controller 50 maintains the stand-by status until such signal is input. In the present embodiment, during the stand-by status, the carriage 4 is at its ink supply position within the ink supply area, and the cap 26 is at the sealing position and as such sealing the discharge nozzles of the print head 1. Furthermore, the sub tank 30 and the supply nozzle 34 are connected at the first position 102 during the stand-by status (see FIG. 2A). With such a configuration, the adhesion of impurities such as dust and drying of ink within the supply nozzle 34 is prevented.

When the printing signal is input ("YES" in S100), the connecting mechanism 36 is controlled so that the main tank 30 and the supply nozzle 34 are moved upward, and the supply nozzle 34 and the sub tank 30 are disconnected at the first position 102 as shown in FIG. 3A (S110). Along with the above-mentioned disconnection, the cap 26 is moved from the sealing position to the stand-by position.

Then, as shown in FIG. 4A, the print head 1, carriage driving mechanism 6 and paper feeding mechanism 14 are controlled so that the carriage 4 is moved to the printing area to begin the printing process (S120). In accordance with the printing data, the carriage 4 moves back and forth as ink is discharged from the print head 1, while the printing medium 2 is fed through the printing area.

Then, during printing, whether or not the sub tank 30 needs ink replenishment is determined (S130). This determination can be done, for example, based on the data detected by an ink remainder sensor (not shown in the figures) arranged on the sub tank 30. The ink remainder sensor detects the amount of ink remaining inside the sub tank 30. The remaining amount of ink can also be calculated from the ink consumption according to the printing data. In this step, it is determined whether the amount of ink inside the sub tank 30 is less than the predetermined limit amount, and if replenishment of ink is necessary. At the beginning of the printing process, for example, there is plenty of ink inside each of the sub tank 30, so it will be determined that replenishment of ink is unnecessary ("NO" in S130).

Then, it is determined whether or not the printing data has been completely printed and the printing has been completed (S240). If printing has not been completed ("NO" in S240), steps of S130, S240 and other necessary steps are repeatedly performed, and depending on the determination of the aforementioned steps, other necessary steps as will be described below are performed.

If the remaining ink inside the sub tank 30 is less than the predetermined limit, and it was determined that the replenishment of ink is necessary ("YES" in S130) during the process of repeating the steps of S130 and S240, a preliminary ink discharge is executed (S140). In the case where the replenishment has not been carried out for a while during printing, the ink inside the supply nozzle 34 may potentially be dehydrated. Hence, the pump mechanism 42 is controlled so that the pump 46 drives air into the main tank 32. The air driven into the main tank 32 compels the ink to discharge from the supply nozzle 34. Thus, impurities that may have adhered inside the supply nozzle 34, such as the drying ink and dust, are washed off along with the ink liquid that is discharged by the process of step S140. In this step, the ink inside the supply nozzle 34 is preliminarily discharged before the supply nozzle 34 is connected to the sub tank 30. Thus, the transfer of such impurities into the sub tank 30 is prevented.

When the process of step S140 is carried out, the print head 1 and the sub tank 30 are located within the printing area, as shown in FIGS. 4A and 4B. The above mentioned preliminary discharge from the supply nozzle 34 occurs within the ink supply area, hence the ink drips and impurities (if any) that are discharged by the preliminary ink discharge motion fall onto the foam 48 that is placed under the main tank 32, and absorbed therein (see FIG. 5). The ink discharged in the preliminary discharge from the supply nozzle 34 will not contaminate the sub tank 30 and the print head 1. Furthermore, when the print head 1 is processing printing, the cap 26 is in its stand-by position. Therefore, the cap 26 will likewise not be contaminated by the ink discharged in the preliminary ink discharge. It is also possible to strain the ink absorbed by the foam 48 by using filters, and return it to the main tank 32.

Not much ink needs to be discharged in the step S140. The amount of ink only needs to be sufficient enough to wash out the impurities that may exist in the distal end of the supply nozzle 34.

While the preliminary discharge of step S140 is being processed, the printing process is still continuing. Thus, the printing motion of the print head I is temporarily stopped, and the printing process is paused (S150). Then, the carriage driving mechanism 6 is controlled in order to move the carriage 4 to the ink supply position within the ink supply area (S160).

Then, it is determined whether the number of times which the supply nozzle 34 and the sub tank 30 has been connected at the connecting position that is presently used is within the predetermined number (S170). If the number of connection made at the first position 102 is within the predetermined number ("YES" in S170), the connecting mechanism 36 is controlled in order to connect the supply nozzle 34 to the sub tank 30 (S180). The motor 38 is driven to move the supply nozzle 34 downward so as to pierce through the first position 102. In this case, the count value counted by the counter 45 is incremented.

On the other hand, if the number of connection made at the first position 102 exceeds the predetermined number ("NO" in S170), there is a substantial possibility that the first position 102 is degraded from the repetitive insertion of the supply nozzle 34. The first position 102 may be damaged, or fatigued, and further usage thereof may result in undesirable conditions such as contamination of the ink inside the sub tank 30, clogging of the filters therein, and demeaning of the sealing thereof.

Thus, in such case, the connecting position adjusting mechanism 41 is controlled to move the supply nozzle 34 so as to adjust the connecting position of the supply nozzle 34 from the first position 102 to the second position 104 (S175). Then, the supply nozzle 34 is moved so as to pierce through the second position 104 by the control of the connecting mechanism 36 (S180).

In the process of step S175, the position of which the supply nozzle 34 pierces through the sealing member 40 is changed from the first position 102 to the second position 104. After processing the step of S175, the supply nozzle 34 is inserted into the sealing member 40 at the adjusted connecting position, the second position 104, which has not yet fatigued nor degraded. Even in the case where the former connecting position (that is, the first position 102 in the present embodiment) is fatigued, or the material of the sealing member 40 therearound is degraded, the transfer of foreign substances therefrom, and the undesirable condition due to such transfer is prevented. Furthermore, the fatigued first position 102 will not be used, so as not to demean the sealing thereof. The sealing of the sealing member 40 is thus maintained, preventing the increase of viscosity of the ink inside the sub tank 30.

In the present embodiment, the supply nozzle 34 and the sealing member 40 are repeatedly connected at the same connecting position (that is, the first position 102 or the second position 104) within the predetermined number of connection. However, the connecting position can be adjusted each time the connection is necessary. For example, first position 102 and the second position 104 may be orderly used. As mentioned earlier, the sealing member 40 is detachably coupled to the main body 31 of the sub tank 30. If the number of times which the supply nozzle 34 and the sub tank 30 has been connected exceeds the predetermined number with both of the positions 102 and 104, the sealing member 40 can be exchanged to a new one. The whole of the sub tank 30 does not need to be exchanged.

After the sub tank 30 and the supply nozzle 34 are connected in the process of step S180, the pump mechanism 42 is controlled in order to replenish ink into the sub tank 30 (S190). The pump 46 is driven so that air is driven into the main tank 32. As shown in FIG. 6A, the air driven into the main tank 32 forces the ink therein to be discharged from the supply nozzle 34, and the ink is replenished into the sub tank 30.

Moreover, even in the case where the connecting position of the supply nozzle 34 has been adjusted to the second position 104 by the process of step S175, as shown in FIG. 6B, the air is likewise driven into the main tank 32, and the ink is replenished to the sub tank 30.

Then, it is determined if the sub tank 30 has been replenished with the necessary amount of ink (S200). If the sub tank 30 has not been replenished sufficiently ("NO" in S200), the process of step S190 is continued and the pump 46 is driven until the sub tank 30 is replenished with the necessary amount of ink.

In the case where a sensor is used to detect the amount of ink inside the sub tank 30, the above-mentioned determination for step S200 can be done based on the amount of ink detected by the sensor. Furthermore, the amount of ink replenished into the sub tank 30 is determined by the driving rate of the pump 46, hence the determination for step S200 can also be done by detecting the driving rate of the pump 46.

When the sub tank 30 is replenished with the necessary amount of ink ("YES" in S200), the driving of the pump 46 is ceased (S210). Then, the connecting mechanism 36 is controlled in order to drive the motor 38 so that the supply nozzle 34 is moved upward so as to disconnect the supply nozzle 34 from the sub tank (S220). As a result, the supply nozzle 34 is withdrawn from the seal member 40 of the sub tank 30, as shown in FIGS. 3A and 3B.

Then, the printing process is resumed (S230). The print head 1, carriage driving mechanism 6 and the paper feeding mechanism 14 are controlled so that the carriage 4 is moved back into the printing area, and ink is discharged from the print head 1 in accordance with the printing data.

After the printing process is resumed, the determination of whether or not the printing has completed is carried out (S240). If printing has not completed ("NO" in S240), the processes of step S130 through step S240 are repeated. During the repetition of the aforementioned steps, the preliminary ink discharge is carried out if the sub tank 30 needs to be replenished ("YES" in S130). In such a case, the pump 46 is driven in order to discharge ink from the main tank 32, and washes away the impurities adhering inside the supply nozzles 34 prior to the replenishment process of S190.

Also during the repetition of the aforementioned steps, the number of times which the supply nozzle 34 and the sub tank 30 has been connected at the connecting position presently used is determined before connecting the supply nozzle 34 with the sub tank 30. If the number of the connecting times is within the predetermined number ("YES" in S170), it is assumed that the seal member 40 has not been fatigued at the presently used position, and the normal function thereof can be expected. If the number of the connecting times exceeds the predetermined number ("NO" in S170), it is assumed that the seal member 40 has been fatigued, and further usage of the presently used position may result in aforementioned undesirable conditions. The connecting position is thus adjusted so that the supply nozzle 34 can be connected to the sub tank 30 through another position. Then, the printing process is resumed after ink has been replenished.

On the other hand, as shown in FIG. 8B, if it is determined during step S240 that the printing process is complete ("YES" in S240), the preliminary ink discharge is processed (S250). In the process of preliminary discharge, the pump mechanism 42 is controlled. Air is driven into the main tank 32 by the pump 46, and the ink from the main tank 32 is preliminarily discharged from the supply nozzle 34. During the process of step S250, the carriage 4 remains within the printing area, and not within the ink supply area.

As in the case of step S140, before connecting the supply nozzle 34 with the sub tank 30, the impurities within the supply nozzle 34 are washed out with the preliminary discharge in the process of step S250. Hence, the transfer of such impurities into the sub tank 30 can be prevented. The sub tank 30 and the print head 1 will not be contaminated.

Then, the carriage driving mechanism 6 is controlled in order to move the carriage 4 to the ink supply position within the ink supply area (S260). Simultaneously, the cap 26 is moved from the stand-by position to the sealing position.

The timing of which the preliminary discharge is processed is not restricted to the timing shown in FIGS. 8A and 8B, as long as it is performed before the carriage 4 moves to the ink supply position. For example, it is also possible to execute the preliminary discharge while the carriage 4 is being moved to the ink supply position.

Then, it is determined whether the number of times which the supply nozzle 34 and the sub tank 30 has been connected at the presently used connecting position is within the predetermined number (S270). If the number of connection made is within the predetermined number ("YES" in S270), the connecting mechanism 36 is controlled in order to connect the supply nozzle 34 with the sub tank 30 (S280). For example, if the first position 102 is presently used as the connecting position, the motor 38 is driven to move the supply nozzle 34 downward, and pierce through the first position 102 as shown in FIG. 2A. In this case, the count value counted by the counter 45 is incremented.

On the other hand, if the number of connection made exceeds the predetermined number ("NO" in S270), the connecting position adjusting mechanism 41 is controlled to adjust the connecting position (S275). If the first position 102 is presently used as the connecting position, the motor 43 is driven to move the supply nozzle 34 along the sealing member 40 to a position which the supply nozzle 34 is located above the second position 104 (see FIG. 3B). Then, the connecting mechanism 36 is controlled that the supply nozzle pierces through the second position 104, and be connected to the sub tank 30 (S280).

In the process of step S275, the position of which the supply nozzle 34 pierces through the sealing member 40 is changed. After processing the step of S275, the supply nozzle 34 can be inserted into the sub tank 30 at a connecting position that has not yet fatigued nor degraded. The undesirable condition due to transfer of foreign substances that may occur at the formerly used connecting position is prevented. The sealing of the sealing member 40 thereof is also maintained, preventing the increase of viscosity of the ink inside the sub tank 30.

After the sub tank 30 and the supply nozzle 34 are connected, the pump mechanism 42 is controlled in order to replenish ink to the sub tank 30 (S290). The pump 46 is driven so that air is driven into the main tank 32. As shown in FIGS. 6A and 6B, the air driven into the main tank 32 forces the ink therein to be discharged from the supply nozzle 34, and the sub tank 30 is replenished with ink.

Then, it is determined if the sub tank 30 has been replenished with the necessary amount of ink (S300). If the sub tank 30 is not yet replenished sufficiently ("NO" in S300), the process of step S290 is continued and the pump 46 is driven until the sub tank 30 is replenished with the necessary amount of ink.

When the sub tank 30 has been replenished with the necessary amount of ink ("YES" in S300), the driving of the pump 46 is ceased (S310). The controller 50 returns to the process of step S100, and again determines if printing signal is input, while the ink jet printer 100 maintains its stand-by status.

In the stand-by status until the printing data is input, the supply nozzle 34 is maintained connected with the seal member 40 at the connecting position at which it pierced in the process of S280. Thus, the supply nozzle 34 and the sub tank 30 are maintained connected. Such configuration prevents the supply nozzle 34 to be exposed to air. The drying of ink inside the supply nozzle 34 can be effectively prevented during the stand-by status. Then, if printing data is input ("YES" in S100), the whole cycle of steps S110 to S310 is repeated.

Furthermore, in the present embodiment, the supply nozzle 34 and the sub tank 30 are connected during the stand-by status of the ink jet printer 100. However, the supply nozzle 34 may be covered by a cap not shown in the figures, so as to be sealed thereof. In such a case, the supply nozzle 34 and the sub tank 30 are disconnected during the stand-by status.

Furthermore, in the present embodiment, the connecting position adjusting mechanism 41 moves the supply nozzle 34 to change the connecting position from the first position 102 to the second position 104. However, the connecting position adjusting mechanism 41 is not restricted to such configuration. The connecting position adjusting mechanism 41 should be able to move the supply nozzle 34 with respect to the carriage 4, so as to adjust the relative spatial relationship regarding the connecting position of the seal member 40 and the supply nozzle 34.

Figure 9:
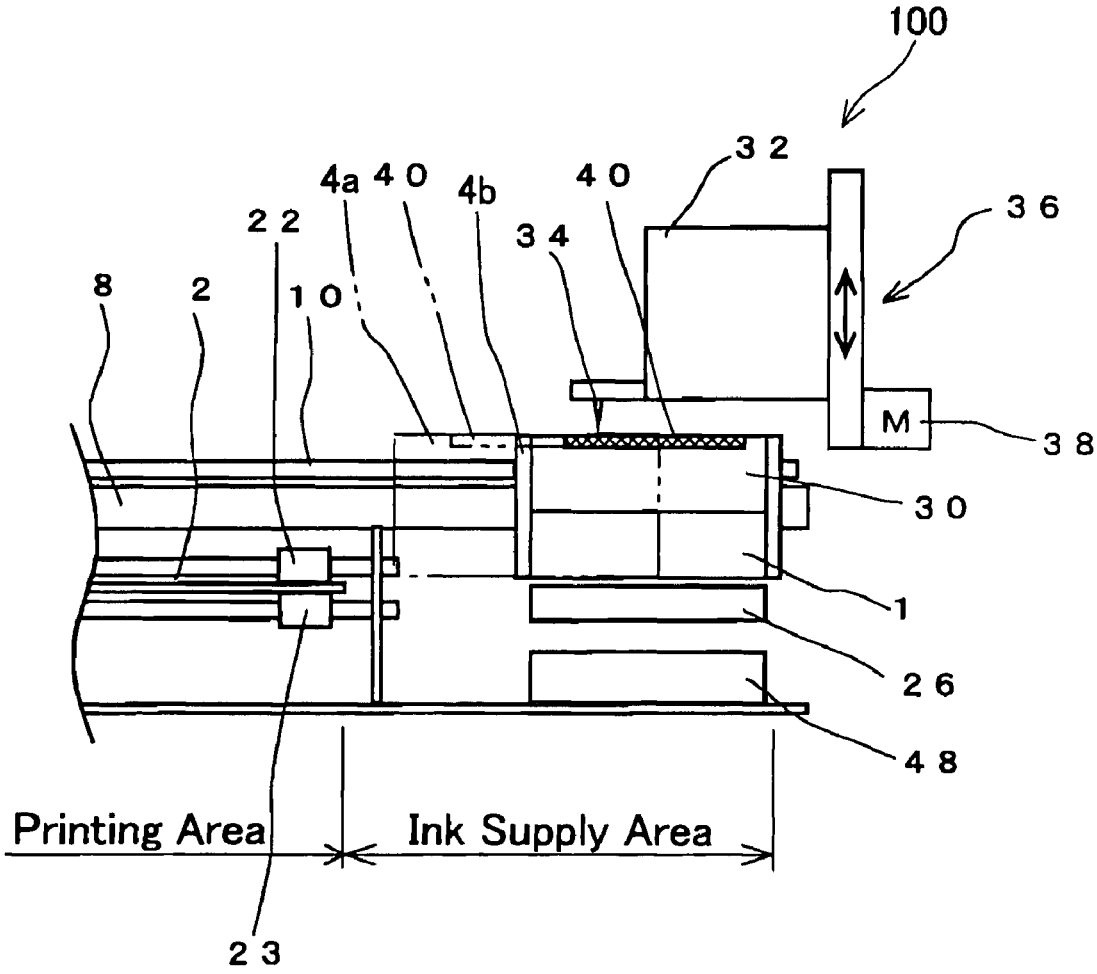
FIG. 9 shows a variant of the ink supply device.

FIG. 9 shows a variant of the ink jet printer 100. As shown in FIG. 9, the sealing member 40 is arranged so that its lengthwise direction (that is, the direction in which the sealing member is elongated) is parallel to the moving direction of the carriage 4. The supply nozzle 34 can be moved in the up and down direction (shown with an arrow) by the connecting mechanism 36 to pierce through the seal member 40.

Furthermore, the carriage 4 is capable of stopping at different stopping positions within the ink supply area. For example, if the carriage 4 is stopped at a first stopping position 4*a* shown with dotted line, the supply nozzle 34 and the sub tank 30 are connected at the first position 102. If the carriage 4 is stopped at a second stopping position 4*b* shown with solid line, the supply nozzle 34 and the sub tank 30 are connected at the second position 104. Even with such configuration, the sealing member 40 can be used under healthy condition by changing the connecting position in which the supply nozzle 34 is inserted in accordance with the number of times the connection has been made. The transfer of foreign substances into the sub tank 30 can be prevented, and, at the same time, the durability of the sealing member 40 can be efficiently maintained.

With the aforementioned configuration, the relative spatial relationship of the supply nozzle 34 and the sealing member is adjusted by the control of the stopping position of the carriage 4. Moreover, in such case, the carriage driving mechanism 6 functions as the connecting position adjusting mechanism. The construction of the ink jet printer 100 is simplified.

In the embodiment as described above, sheets of paper are assumed as the printing medium 2. However, the printing medium 2 is not restricted to such medium. The printing medium 2 may be a glass substrate, a silicon substrate, resin film, or the like. In such cases, corresponding change in the construction of the paper feeding mechanism 14 is required. Furthermore, the printing medium 2 may have a curved surface, instead of a flat surface as is described in the embodiment above.

Moreover, in the embodiment as described above, the present invention is applied to an ink jet printer which discharges ink to print images onto the printing medium 2. However, the present invention can be adequately applied to other liquid discharge devices that discharges liquids other than ink, for example, reagent liquid, biological solution, electrical wiring material solution, electronic material solution, adhesive solution, resinous liquid for geometric molding, or the like.

What is claimed is:

1. A liquid discharge device, comprising:

a casing comprising a space for housing a main tank;

a carriage configured to move;

a discharge head arranged on the carriage;

a sub tank arranged on the carriage, the sub tank communicating with the discharge head;

a supply nozzle to be communicated with the main tank; and a moving device configured to move the supply nozzle with respect to the carriage at a first timing at which an ink is to be replenished to the sub tank from the main tank, such that the supply nozzle pierces through a first position of the sub tank and is inserted into the sub tank;

wherein the moving device is configured to further move the supply nozzle with respect to the carriage at a second timing after the first timing, at which the ink is to be replenished again to the sub tank from the main tank, such that the same supply nozzle that has pierced through the first position at the first timing pierces through a second position of the sub tank and is inserted into the sub tank; and wherein the second position is a different position from the first position.

2. The liquid discharge device as in claim 1;

wherein the carriage is capable of stopping at a predetermined position, and wherein the moving device moves the supply nozzle such that the supply nozzle is inserted into the sub tank when the carriage is stopping at the predetermined position.

3. The liquid discharge device as in claim 1;

wherein the moving device is capable of controlling a stopping position of the carriage;

wherein the supply nozzle pierces through the first position of the sub tank when the carriage is stopping at a first stopping position; and wherein the supply nozzle pierces through the second position of the sub tank when the carriage is stopping at a second stopping position.

4. The liquid discharge device as in claim 1, further comprising:

a counter that counts a number of times which the supply nozzle pierces through the first position of the sub tank;

wherein the moving device changes a piercing position of the supply nozzle with respect to the sub tank from the first position to the second position in a case where the number of times counted by the counter exceeds a predetermined number.

5. The liquid discharge device as in claim 1;

wherein the sub tank comprises a tank main body and a sealing member coupled to the tank main body; and wherein the first position and the second position are located at the sealing member.

6. The liquid discharge device as in claim 5;

wherein the sealing member is made of elastic material.

7. The liquid discharge device as in claim 5;

wherein the sealing member is detachably coupled to the tank main body.

8. The liquid discharge device as in claim 1;

wherein the moving device comprises a first moving device and a second moving device;

wherein the first moving device moves the supply nozzle in a first direction to determine a piercing position of the supply nozzle with respect to the sub tank; and wherein the second moving device moves the supply nozzle in a second direction to make the supply nozzle pierce through the sub tank.

9. The liquid discharge device as in claim 1;

wherein the casing comprises a liquid supply area; and wherein the supply nozzle pierces through the first position and the second position of the sub tank within the liquid supply area.

10. The liquid discharge device as in claim 1, further comprising:

an energy supply device that supplies energy to liquid within the main tank such that the liquid within the main tank is supplied to the sub tank via the supply nozzle.

11. The liquid discharge device as in claim 1;

wherein the liquid discharge device is an ink jet pointer; and wherein the liquid is ink.

12. A liquid discharge device, comprising:

a casing comprising a space for housing a main tank;

a carriage configured to move;

a discharge head arranged on the carriage;

a sub tank arranged on the carriage, the sub tank communicating with the discharge head;

a supply nozzle to be communicated with the main tank; and a moving device configured to move the supply nozzle with respect to the carriage such that the supply nozzle pierces through the sub tank and is inserted into the sub tank more than once;

wherein the moving device is configured to change a piercing position of the supply nozzle with respect to the sub tank from a first position to a second position that is different from the first position;

wherein the supply nozzle pierces through the first position at a first dining at which an ink is to be replenished to the sub tank from the main tank; and wherein the same supply nozzle that had pierced through the first position at the first timing pierces through the second position at a second timing after the first timing, at which the ink is to be replenished again to the sub tank from the main tank.

* * * * *